United States Patent [19]

Bickes, Jr. et al.

[11] Patent Number: 4,708,060

[45] Date of Patent: Nov. 24, 1987

[54] SEMICONDUCTOR BRIDGE (SCB) IGNITER

[75] Inventors: Robert W. Bickes, Jr.; Alfred C. Schwarz, both of Albuquerque, N. Mex.

[73] Assignee: The United States of America as represented by the United States Department of Energy, Washington, D.C.

[21] Appl. No.: 702,716

[22] Filed: Feb. 19, 1985

[51] Int. Cl.[4] ..... F42B 3/12; F42C 19/12

[52] U.S. Cl. ..... 102/202.7; 102/202.5

[58] Field of Search ..... 102/202.7, 202.5

[56] References Cited

U.S. PATENT DOCUMENTS

| | | | |
|---|---|---|---|
| 3,018,732 | 1/1962 | Tognola | 102/202.8 |
| 3,019,732 | 2/1962 | Kaspaul | 102/202.8 |
| 3,211,096 | 10/1965 | Forney et al. | 102/202.5 |
| 3,292,537 | 12/1966 | Goss, Jr. | 102/202.9 |
| 3,366,055 | 1/1968 | Hollander, Jr. | 102/202.7 |
| 3,602,952 | 9/1971 | Grinnell et al. | 324/62 |
| 3,978,791 | 9/1976 | Lemley et al. | 102/202.14 |
| 4,471,697 | 9/1984 | McCormick et al. | 102/202.5 |

OTHER PUBLICATIONS

Swartz, Alfred C.; "Experimental Performance of the TC 817 Flying Plate Test Device"; SAND 78-1491, Feb. 1979.

*Primary Examiner*—Charles T. Jordan

*Attorney, Agent, or Firm*—George H. Libman; Albert Sopp; Judson R. Hightower

[57] ABSTRACT

In an explosive device comprising an explosive material which can be made to explode upon activation by activation means in contact therewith;

electrical activation means adaptable for activating said explosive material such that it explodes; and electrical circuitry in operation association with said activation means;

there is an improvement wherein said activation means is an electrical material which, at an elevated temperature, has a negative temperature coefficient of electrical resistivity and which has a shape and size and an area of contact with said explosive material sufficient that it has an electrical resistance which will match the resistance requirements of said associated electrical circuitry when said electrical material is operationally associated with said circuitry, and wherein said electrical material is polycrystalline; or said electrical material is crystalline and (a) is mounted on a lattice matched substrate or (b) is partially covered with an intimately contacting metallization area which defines its area of contact with said explosive material.

11 Claims, 6 Drawing Figures

Fig. 3a
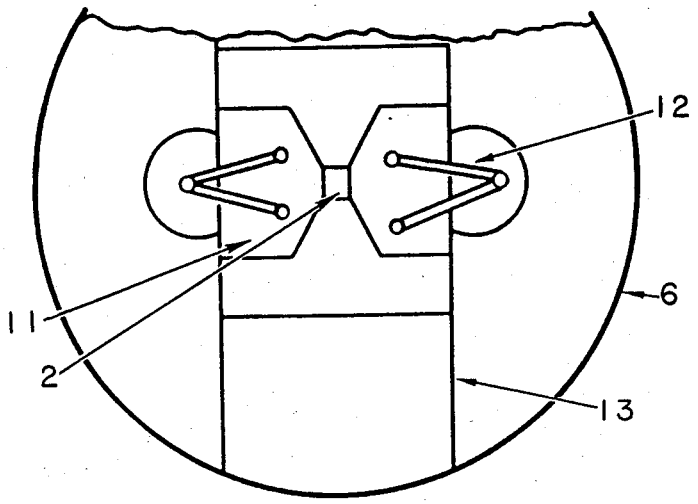
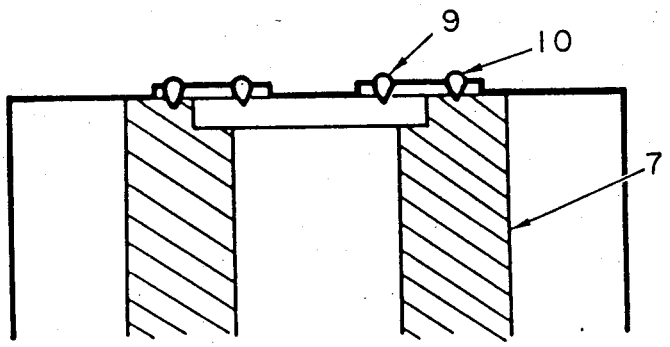
Fig. 3b

SEMICONDUCTOR BRIDGE (SCB) IGNITER

The U.S. Government has rights in this invention pursuant to Contract No. DE-AC04-76DP00789 between the U.S. Department of Energy and AT&T Technologies, Inc.

BACKGROUND OF THE INVENTION

This invention relates to a new igniter of a semiconductor nature which is especially useful in conjunction with insensitive high explosives and pyrotechnics.

Various means for detonation, deflagration or other activation of explosives, including the mentioned high explosives, are known. For example, U.S. Pat. No. 3,018,732 discloses a spark gap device. U.S. Pat. No. 3,019,732 also discloses another type of spark igniter. U.S. Pat. No. 3,211,096 is typical of thermal methods for ignition, e.g., hot wire devices. U.S. Pat. No. 3,978,791 and U.S. Pat. No. 3,292,537 also typify hot wire detonators. Slapper detonators are also known, but these require high voltage, high power, and complex and costly capacitive firing sets along with precision manufacturing and alignment. See, e.g., *Sandia Report* 78-1491 by A. C. Schwarz.

The disclosure of U.S. Pat. No. 3,366,055 describes a semiconductor device capable of fast, low energy detonation of high explosives. The theory of this patent relates to the use of a strongly crystalline structure having semiconductor properties such that it has a sharp inflection point at which the change from extrinsic to intrinsic conduction occurs, whereby resistivity decreases sharply. At this point, a shock wave is released capable of detonating a high explosive. This turnover point was believed to be controlled by controlling the doping level of the semiconductor and matching it with the desired autoignition temperature for the specific explosive involved. However, applicants have determined that the doping level is not germane to the critical aspects of final performance.

As a result, a new design for a semiconductor-based method of igniting/detonating high explosives is needed.

SUMMARY OF THE INVENTION

Accordingly, it is an object of this invention to provide a device suitable for ignition of explosives, preferably including insensitive high explosives and pyrotechnics.

It is another object of this invention to provide a device which can be actuated by very low energy, current pulses and yet which achieves adequately high and safe no fire levels.

It is yet another object of this invention to provide a device which is useful in conjunction with a wide range of explosives and, preferably, which is capable of inexpensive and simple assembly and manufacture.

It is still another object of this invention to provide a device wherein the components are integratable with other components of the explosive system.

Upon further study of the specification and appended claims, further objects and advantages of this invention will become apparent to those skilled in the art.

These objects have been attained by providing a non electrically-conducting substrate supporting an electrical material having a negative coefficient of electrical resistivity at an elevated temperature and defining a pair of spaced pads and a connecting bridge having a resistance of less than about three ohms. The area of each of the pads is much larger than the area of the bridge and is covered by a metallized layer. An electrical conductor is connected to each metallized layer and explosive material covers the device. When an electrical current passes through the device, the bridge bursts, igniting the explosive material.

BRIEF DESCRIPTION OF THE DRAWINGS

Various other objects, features and attendant advantages of the present invention will be more fully appreciated as the same becomes better understood when considered in connection with the accompanying drawings, in which like reference characters designate the same or similar parts throughout the several views, and wherein:

FIGS. 2 and 3 show views of the SCB of the invention in its end use environment.

DETAILED DISCUSSION

Figure 2A:
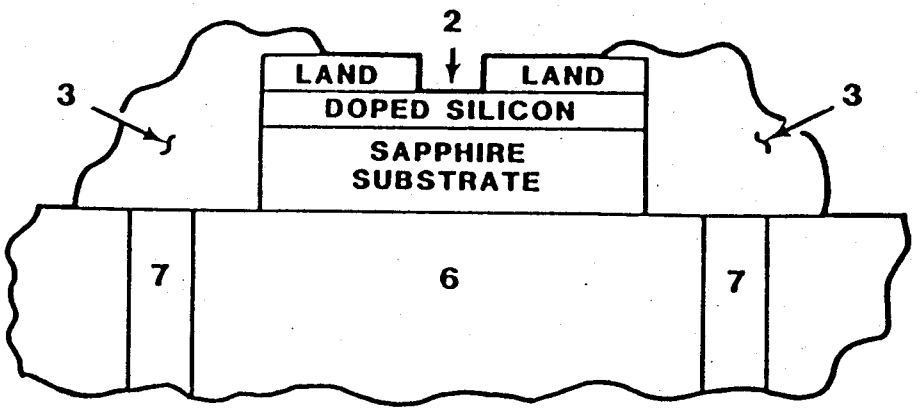
Figure 2B:
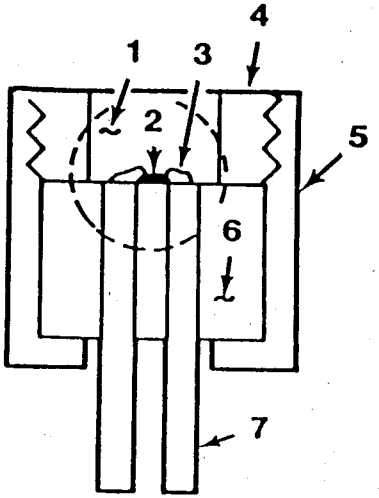

The structure of this invention is shown in the Figures and described in detail in the examples. As shown in FIG. 2, one embodiment of the invention includes a highly doped silicon layer 3 on sapphire substrate 8. Metallized lands 11 cover most of silicon layer 3, leaving only a connecting bridge 2 uncovered. Substrate 8 is mounted on a ceramic header 6 having two spaced electrical conductors 7 extending therethrough and connected through solder 3 to lands 11. A metal housing 5 surrounds header 6 and holds explosive powder 1 in contact with bridge 2.

Because of the particular arrangement of sizes and materials described herein, the device is very resistant to accidental discharge caused by static electricity or other unintentional voltages applied across conductors 7. However, the device will rapidly ignite powder 1 in response to the designed electrical signal.

Figure 1A:
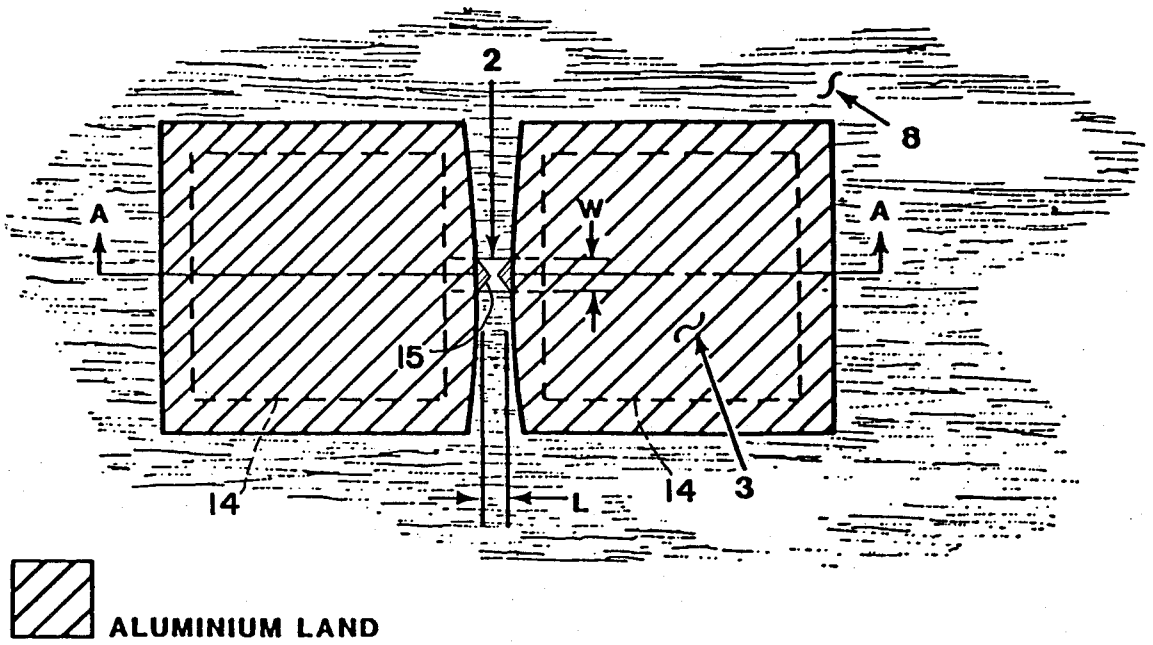
FIG. 1 shows top and side views of the SCB of the invention.
Figure 1B:
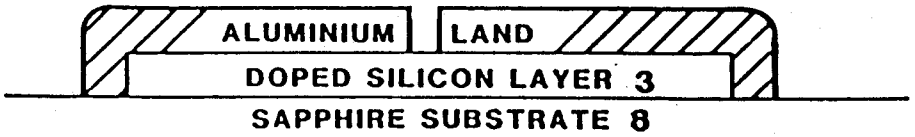

FIG. 1 shows the relationship between layers which must be present in this invention. Silicon layer 3 includes a pair of spaced pads 14 connected by bridge 2. Although the size and shape of bridge 2 is important, as discussed hereinafter, pads 14 may be of any shape as long as the area of each pad is much larger than the area of bridge 2. Each pad is covered by land 11, ensuring that the resistance between conductors 7 is determined almost entirely by the resistance of bridge 2, the only portion of doped silicon layer 3 that is not covered by lands 11. The metallization of lands 11 may extend on bridge 2 as a triangularly shaped indentation 15 as discussed hereinafter.

Studies of the details of this invention have demonstrated that the system does not operate by a simple shock wave nor by simple thermal initiation as stated in the mentioned U.S. Pat. No. 3,366,055. Rather, the activation of the explosive is believed to be caused by a combination of ignition/initiation effects, i.e., essentially a process of burning, but also involving the formation of a thin plasma and a resultant convective shock effect. The new under-standing of this invention and the theorized method of its operation has led to a device significantly different from that of U.S. Pat. No. 3,366,055.

For example, to facilitate the achievement of desirable no-fire levels, where a crystalline semiconductor element is used in this invention, it is highly preferred that the crystal be grown on a matched substrate, i.e., a substrate having the conventional match of its lattice constant to that of the semiconductor crystal grown thereon. In addition, irrespective of the nature of the semiconductor (crystalline or polycrystalline), it is also greatly preferred that the electrical contacts of the active semiconductor or other element of this invention be made using conventional lands (deposited metallization layers) rather than the simple direct solder leads employed in U.S. Pat. No. 3,366,055. Applicants have determined that the latter are inappropriate for effective, reliable, efficient and/or safe activation of explosives. Moreover, it has now been discovered that polycrystalline forms of semiconductors can be very conveniently employed in the method and device of this invention. Semiconductors of this nature require no matching substrate. All of these factors are significant differentiating features with respect to the device and method of U.S. Pat. No. 3,366,055.

A prime feature of this invention relates to the "electrical" material which forms the heart of the activation system. A major requirement for this material is that it develop a temperature coefficient of electrical resistivity which is negative at some temperature, e.g., some temperature above room temperature, e.g., about 100° C. The precise temperature is not critical. Essentially all semiconductors will have this property at sufficiently high doping levels. In general, it is preferred that the semiconductor material be doped essentially at or near its saturation level, e.g., approximately $10^{19}$ atoms/cc, e.g., phosphorus atoms for n-type silicon. Lower doping levels may also be operable under appropriate conditions which can be determined routinely in accordance with the guidelines given in this disclosure. For example, doping levels lower by a factor of 2 from this value will also provide adequate properties for the purposes of this invention. Corresponding resistivity values will be on the order of $10^{-3}$ to $10^{-4}$, e.g., about $8\times10^{-4}$ Ω.cm for the mentioned saturation doping level. However, other than as explained above, resistivity values per se are not critical.

Essentially any semiconductor material will be appropriate for layer 3 as long as it meets the various requirements described herein, most notably having the necessarily negative temperature coefficient of electrical resistivity. These include not only single element semiconductor materials but also binary, ternary, quaternary, etc. alloys. These may be taken from any of the usual combinations from Groups III–VI of the periodic table, inter alia. Non-limiting examples include germanium, indium arsenide, gallium arsenide, $Ga_{1-x}In_xAs$, $GaAs_{1-x}P_x$, etc. Silicon-based materials are preferred for essentially the same reasons that such materials are preferred for most semiconductor applications.

Materials other than semiconductors per se will also be useful as long as they have the mentioned negative temperature coefficient. For example, rare earth metal oxides, e.g., uranium oxide, have the necessary negative resistivity coefficient. Possession of this characteristic will ensure that the activation phenomenon involving the formation of a plasma as discussed above, will occur. Thus, although this description is written in terms of semiconductors primarily, it is intended to encompass these other suitable materials.

The precise doping level/resistivity value of the active element material will also be routinely selected in accordance with this disclosure to satisfy the electrical resistivity requirements of the electrical circuitry in which the activation element of this invention is to be employed. A most common industry-wide standard in this regard for activation of high energy and other explosives is a room temperature bridge resistance no larger than 1Ω. Appropriate semiconductor characteristics to achieve this macroscopic resistance can easily be designed in accordance with this disclosure. Other bridge resistances, of course, can also be achieved by this invention.

An additional important factor in achieving the desired bridge resistance value is the geometry of the semiconductor bridge element of this invention. For example, an area in contact with the explosive material of approximately 100 μm×100 μm±about one order of magnitude in area will usually be satisfactory for achieving a desired bridge resistance of about 1Ω. Typically, the thickness of the bridge element will be on the order of a few micrometers, e.g., 1–10 μm, or 2–5 μm, preferably, about 2 μm. Again, precise values are routinely selectable using conventional optimization principles. It has been found that SCB lengths of greater than 200 μm can adversely affect the operability of the SCB at low voltages.

Also significant in selecting the desired semiconductor bridge element will be the need to have a sufficient area and volume to provide sufficient heat input to the explosive material to achieve the intended effect. Values within the ranges discussed above are indicative of the effective range. The geometry will also impact the minimum energy and minimum pulse width or rise time of the applied voltage which will be effective to activate the explosive. Again, values within the ranges mentioned above will be suitable, optimized values being readily determinable in all cases in accordance with the guidelines provided herein.

The effective area of the bridge element of this invention when it is in association with the explosive material will be determined in general by the geometry of an upper layer used to provide contact with the circuitry of the explosive device. For example, photopatterned lands (metallized layers of high electrical conductivity) will normally be employed to provide means for the necessary electrical contact, subsequently effected, e.g., by soldering, laser welding, sonic welding techniques, etc. Typical such upper coatings will be composed of the highly electrically conductive metals such as gold, silver, copper, aluminum, etc. Metallized lands are made to semiconductor or other substrates by a very intimately contacting process, e.g., by epitaxial or CVD deposition onto the underlying substrate in the highly conventional photopatterning-type operations. Such contacting surfaces are very significantly different from the direct solder contact joints employed in the device of U.S. Pat. No. 3,366,055. The nature of this contact is one of the significant features differentiating the invention from the prior art reference when a crystalline semiconductor is used. In the invention, lands 11 ensure that powder 1 is only ignited by the bridge, and that the resistance between conductors 7, which is dependent only on the carefully controlled material and size of bridge 2, is uniform from sample to sample, thus ensuring uniform sample to sample operation.

The shape of the semiconductor bridge element is not critical in the sense that any shape will provide an operative device as long as the various conditions discussed herein are met. Typically, the device will have an overall rectangular shape. As mentioned, this shape is determined by the masking effect of the superimposed metallization contact layer. It has been found in a preferred embodiment of this invention that the shape of the metallized layer can impact the characteristics of the device in operation. For example, advantageous breakdown effects can be provided if the border between the exposed SCB and the metallized layer includes more or less triangularly shaped indentations 15 wherein the base of the triangle is along the border and the apex is on the SCB side of the border.

When a crystalline semiconductor element is employed, the substrate used must have a satisfactory lattice match with the lattice constant of the semiconductor material to avoid unacceptable imperfections in the epitaxial growth of the semiconductor on the substrate. This is a highly conventional consideration in semiconductor applications and appropriate selection can be made in accordance with well known considerations. For silicon crystals, a suitable substrate is sapphire.

It is also possible to employ a polycrystalline semiconductor material. In this case, the electrically conductive coating will be constituted by lands as described above. Where the preferred polycrystalline materials are employed, substrates are completely non-critical and the nature of its lattice constant is not important. For example, polycrystalline silicon can be deposited on any substrate appropriate for the particular electrical configuration, e.g., crystalline silicon itself, silicon dioxide, etc.

Polycrystalline semiconductors, especially polycrystalline silicon, are the preferred materials for use as the electrical material of this invention. These optimize the manufacturing and cost benefits of this invention and eliminate the need for matching substrates. The well known semiconductor manufacturing processes employed in conjunction with the manufacture of a wide variety of semiconductor devices are fully applicable to the preparation of the devices of this invention in accordance with the guidelines given herein.

Where a substrate is employed, its thermal conductivity provides another parameter by which the operational characteristics of this invention can be modified. For example, if the thermal conductivity of the substrate is raised, the current required in the element of this invention for an inadvertent "no-fire" activation of the explosive material will be increased. That is, heat caused by current fluctuations in the electrical material of this invention will be more efficiently transferred away from the explosive and to the substrate the greater the thermal conductivity of the substrate. This will substantially decrease the probability that such current fluctuations can result in an undesired, inadvertent firing of the explosive.

In any event, the "no-fire" rating of the devices of this invention is exceptionally high. Thermal conductivity of the substrate is merely another means for even further optimizing these values. "No-fire" is a safety test of conventional nature where constant current is applied for 5 minutes or more. The requirement is that the explosive against the bridge not initiate at a certain level of applied current. The industry-wide requirement is for no-fires when one watt of power is applied across a one ohm bridge.

Another major advantage of the devices of this invention is the fact that they can be effectively employed in conjunction with significantly shorter current pulses and significantly lower energies than heretofore employable in conjunction with conventional ignition/-detonation devices. For example, the devices of this invention can be activated by pulses as short as 1–100 μsec or even shorter in appropriate configurations. Typically, pulse lengths of 100n sec.–100 μsec will be employed. The geometry of the bridge element and other features mentioned above can be used to tailor the minimum pulse length which will be applicable. Of course, pulse lengths of much higher values can also be employed if this is acceptable or desirable. Similarly, pulse energies of very low values, e.g., of about 10 mJ or lower, e.g., 1–5 mJ can be employed, again depending upon the specific geometry and other characteristics designed for the semiconductor bridge element. Moreover, the SCB of this invention has a very low volume compared with conventional hot wire elements.

The availability of these highly desirable activation characteristics is a direct result of the novel mechanism for the device of this invention as theorized above. In essence, the minimum energy/pulse width which can effectively consume the bridge and result in explosive activation is extremely low for this invention. Any combination of effective values above the minimum, of course, can be used.

As a result of the characteristics summarized above, the bridge element of this invention provides a unique set of advantages over heretofore available ignition devices. For example, uniquely high speed and low energy pulses can be used to activate explosives. As a result, the device of this invention can be employed in conjunction with explosives of very low sensitivity, e.g., high explosives. Furthermore, because the device can be and preferably is semiconductor in nature, it can be manufactured using highly conventional microcircuitry techniques. This makes the devices very inexpensive and very easily mass-produced (assembly and manufacturing). Moreover, because it can be operated at low voltages (e.g. on the order of about 20 volts), it is compatible with other digital electronics which might be employed in conjunction with the explosive device. For example, it can be directly integrated into other device components including, for example, other semiconductor components such as logic circuits, e.g., safing logic, fire sets, switching circuits, etc. The device of this invention can be integrated onto the same chip or onto adjacent wafers, e.g., hybrids can be used. In addition, because the igniter of this invention has variable power demands, it could be employed in cascade configurations to form large assemblies that could be precisely timed and controlled using conventional digital electronics in conjunction with power supplied by a single firing set.

In another advantage of this invention, derived in part from the short pulses which can be employed, resistance-after-fire (RAF) effects are very greatly minimized. That is, during multiple initiator firings, RAF effects heretofore have imposed a serious limitation in existing devices. These effects in essence rob one device of energy while another is overdriven. That is, the impedance after firing of one device does not remain essentially a short circuit and continuously drain the power from other devices which are in need thereof. This effect is greatly minimized in this invention. This is especially the case when the associated firing set provides a fast rise current input of an amplitude of about 20A or less and of a duration of about 5 μs.

Yet another advantage of the device of this invention is its ruggedness. For example, when mounted on a rugged conventional ceramic header, the device of this invention has been shown to withstand loading pressures of 30,000 psi and greater. The device of this invention can be employed in conjunction with essentially any explosive which is compatible therewith. As mentioned, these include not only highly sensitive explosives but also relatively insensitive ones, e.g., high energy explosives such as but not limited to PETN, HNAB, HMX, pyrotechnics, sensitive primaries, gunpowders, etc. Moreover, the SCB devices will be resistant to X-ray, neutron and gamma radiation.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLE 1

FIGS. 3*a* and 3*b* show a conventionally manufactured prototype silicon 3 on sapphire substrate 8 SCB 2. Each chip (about 1.50 mm square×0.33 mm thick) contained two bridge circuits—one with a bridge whose dimensions where 17 μm long×17 μm wide×2 μm thick and the other 17 μm×35 μm×2 μm. The 1 μm thick lands 11 were aluminum and provided a pad to attach one end of a gold lead wire 12 while the other end was attached to the transistor header 6 used in the detonator build-up.

One serious problem with this early unit was the lack of strength of the gold wire 12 bonding to absorb the pressures during explosive powder 1 compaction. An equally serious problem was the high resistance of the individual bridges (>10Ω). Such a high resistance could pose a safety problem with respect to human-body electrostatic discharge through the bridge if the powder 1 were especially spark sensitive. The bridge (17×35×2 μm) had a resistivity of $60\times10^{-4}$ ohm-cm and was identified as SCB 1. Lower resistivity was desired so that larger bridge dimensions and greater contact with the explosive 1 could be employed. It was determined that a resistivity of the $8\times10^{-4}$ ohm-cm could be achieved by heavy phosphorus doping; therefore, the new baseline bridge dimensions (SCB 2) were then chosen to be 100 μm long×67 μm wide×4 μm thick, resulting in a resistance of 3 ohms. The bridge chip was mounted on a conventional MAD 1031 header 6 which is a high strength ceramic unit, with associated metal housing 5 and charge holder 4. Solder connections 3 and/or ultrasonic welds (9) and/or laser welds (10) attach lead wire 12, which wire was aluminum for this embodiment, between the bridge 2 and posts 7, e.g., of Kovar, were tested and found to be capable of withstanding powder compaction loads up to 30,000 psi. A comparison among SCB 1, SCB 2 and a conventional cylindrical hot-wire (0.002 in diameter; 0.055 in length) is given in Table 1.

TABLE 1

| CONVENTIONAL BRIDGEWIRE MATERIAL | TOPHET C | SCB 1 DOPED Si (ON SAPPHIRE SUBSTRATE) | SCB 2 HEAVILY DOPED Si (ON SAPPHIRE SUBSTRATE) |
|---|---|---|---|
| RESISTIVITY (OHM-CM) | $1.1\times10^{-4}$ | $60\times10^{-4}$ | $8\times10^{-4}$ |
| BRIDGE R (Ω) | 1.0 | 14.5 | 3.0 |
| M.P. (°C.) | 1350 | 1410 | 1410 |
| BRIDGE VOL. ($cm^3$) | $283\times10^{-8}$ | $0.12\times10^{-8}$ | $2.68\times10^{-8}$ |
| THERMAL COND. (cal/cm · s · k) | 0.20 | 0.17 | 0.17 |
| SPECIFIC HEAT (cal/g · k) | 0.11 | 0.20 | 0.20 |

Table 2 gives performance data on a pyrotechnic 1 initiated by SCB's 2. The effectiveness of the semiconductor bridge 2 is apparent. An order of magnitude reduction in initiation energy and function time and enhanced safety via "no-fire" are attributes of the SCB compared to a conventional hot-wire device.

The energy reduction is primarily attributable to the small mass of the SCB. Some credit toward reduction in initiation energy is also attributed to the fast-rise pulse of the firing set which is employable. The no-fire enhancement from 1-watt to 7.5 watts is believed to result in part from the favorable relationship among the thermal properties of the bridge and substrate materials. Very significantly, the thermal contact between the bridge and substrate in the SCB is much better controlled than the bridgewire (unattached) on the glass header in a conventional hot-wire device.

In the alternate and preferred design of FIG. 3 for attachment of chip to the header, aluminum wire 12 (0.0025 in. in diameter) in the configuration shown is employed. The design also features a groove 13 (0.014 in. deep and 0.060 in. wide) which is epoxy filled.

EXAMPLE 2

Bare Bridge SCB Test

Inert SCB 2 units were test fired at different current levels with a pulse duration fixed at 4.4 microseconds. After an immediate surge, the dynamic resistance of the bridge remains nearly constant and below the pre-fire value. Upon loss of the conductive path through the SCB, the bridge bursts into a late time discharge and the resulting plasma formation leads to the ignition of the explosive.

TABLE 2

EFFECTIVENESS OF SCB DEVICE
ENERGETIC MATERIAL:
$TiH_{0.65}/KClO_4$ ($\rho$ = 2.20 $Mg/m^3$)

| | CONVENTIONAL HOT-WIRE DEVICE | SCB DEVICE SCB 1 | SCB 2 | SCB 2 |
|---|---|---|---|---|
| THRESHOLD | | | | |
| CURRENT (A) | 3.5 | 10.9 | 24.0 | 15.5 |
| PULSE LENGTH (μs) | 2000 | 2.6 | 2.6 | 4.4 |
| ENERGY (ergs) | 245,000 | 35,800 | 25,500 | 24,300 |
| CURRENT DENSITY ($MA/cm^2$) | 0.17 | 16.1 | 9.0 | 5.8 |
| BRIDGE RESISTANCE (ohms) | 1.0 | 11.6 | 1.7 | 2.3 |
| NO-FIRE | | | | |
| CURRENT (A) | 1.0 | — | >1.6 | >1.6 |
| POWER (WATTS) | 1 | — | 7.5 | 7.5 |

TABLE 2-continued

| EFFECTIVENESS OF SCB DEVICE ENERGETIC MATERIAL: $TiH_{0.65}/KClO_4$ ($\rho$ = 2.20 Mg/m$^3$) | | | | |
|---|---|---|---|---|
| | CONVENTIONAL HOT-WIRE DEVICE | SCB DEVICE | | |
| | | SCB 1 | SCB 2 | SCB 2 |
| FUNCTION TIME AT THRESHOLD (μs) | >2000 | 50 | 40 | 70 |

All energy computations on SCB performance reported here are based on the full pulse duration and not for the burst time $t_b$, as is customary for exploding bridge wire detonators. "$T_b$" is the time to vaporize the bridge. Hot particles appear to be emanating from the exploded SCB. Blackbody measurements indicated a peak temperature of about 5500 K. for the plasma. (Spectra were sampled for 2 μs starting a few microseconds after the trigger pulse.)

While the inert SCB bridge opens at 5–10A in air, the additional cooling effect of a pyrotechnic pressed against the bridge will increase the level at which the bridge opens to 15–20A with a fully loaded unit.

EXAMPLE 3

Open Bridge Experiment

One SCB expended in the bare bridge tests was recovered. Its resistance indicated "open". The bridge was subsequently mounted in the test configuration described in Example 1 with $TiH_{0.65}/KClO_4$; the bridge resistance then measured 0.95 ohm (as a result of powder conduction). Test firings were made at increasing current levels until reaction occurred at about 140 mJ. This demonstrates that the SCB plays a prominent role in reducing firing energy requirements to the 2.5 mJ threshold level (Table 2).

EXAMPLE 4

Survey of Energetic Material Response to SCB Initiation

Devices containing SCB2 bridges were used to evaluate the initiation sensitivity of high explosives as well as pyrotechnics at room ambient temperature. Data are given in Table 3.

The initiation energy threshold for $TiH_{0.65}/KClO_4$ appeared to be constant energy, about 2.5 mJ, for pulse durations of 2.6 and 4.4 μs. Extrapolation to a 10A current source feeding a 1-ohm bridge suggests the pulse duration need be only about 25 μs for threshold firing. See Table 4.

TABLE 3

IGNITION THRESHOLD ENERGY
FIRING SET: CABLE DISCHARGE
BRIDGE: DOPED Si ON SAPPHIRE SUBSTRATE
BRIDGE SIZE: 100 μm LG × 67 μm W × 4 μm THK (SCB 2)
NOMINAL RESISTANCE: 3 OHMS

| ENERGETIC MATERIAL | DENSITY (Mg/m$^3$) | INPUT PULSE DURATION (μs) | THRESHOLD ENERGY (mJ) | NO-FIRE THRESHOLD (WATTS) | REMARKS |
|---|---|---|---|---|---|
| $TiH_{0.65}/KClO_4$ | 2.20 | 2.6 | *2.55 ± 0.15 | — | |
| | 2.20 | 4.4 | *2.43 ± 0.04 | 7.50 | |
| $TiH_{1.68}/KClO_4$ | 2.20 | 4.4 | *1.85 ± 0.35 | — | |
| PETN | 1.65 | 4.4 | 1.11 ± 0.15 | 1.11 | WITH END CONFINEMENT |
| HNAB | 1.65 | 4.4 | 1.20 ± 0.30 | 1.20 | WITH END CONFINEMENT |
| B-HMX | 1.65 | 4.4 | 1.50 ± 0.60 | — | WITH END CONFINEMENT |

*ENERGY CALCULATION INCLUDES THE ENERGY DISSIPATED IN SHUNTING RESISTANCE OF THE PYROTECHNIC
DEFLAGRATE
TYPICAL HOT-WIRE INITIATION OF $TiH_{0.65}/KClO_4$ REQUIRES 24.5 mJ AND NO-FIRE IS ABOUT 1 WATT

TABLE 4

| EFFECTIVENESS OF SCB DEVICE ENERGETIC MATERIAL: $TiH_{0.65}/KClO_4$ | | | | |
|---|---|---|---|---|
| | CONVENTIONAL HOT-WIRE DEVICE | SCB DEVICE MEASURED | | *EXTRAPOLATED LONGER PULSE |
| | | SHORT PULSE | LONG PULSE | |
| THRESHOLD | | | | |
| CURRENT (A) | 3.5 | 26.8 | 17.4 | 10 |
| PULSE LENGTH (μs) | 2000 | 2.6 | 4.4 | 30 |
| ENERGY (ergs) | 245,000 | 30,000 | 30,000 | 30,000 |
| BRIDGE RESISTANCE (ohms) | 1.0 | 1.7 | 2.3 | 1.0 |
| NO FIRE | | | | |
| CURRENT (A) | 1.0 | >1.6 | >1.6 | 4.0 |
| POWER (WATTS) | 1 | >4 | >4 | 4 |
| FUNCTION TIME AT THRESHOLD (μs) | >2000 | 40 | 70 | 100 |

*Estimated values based on the measured values for the shorter pulse lengths.
(Joule = Watt Second = Erg × $10^7$)

Confined high explosives initiated at even lower energy levels than the pyrotechnics. It is to be emphasized that the high explosives only deflagrated. End confinement over the high explosive (but not over the pyrotechnic) was essential to achieve this performance.

Pyrotechnic devices displayed a 7.5 watt no-fire level. Usually those techniques which decrease function threshold also decrease no-fire threshold. This is not the case here. Considerably more design flexibility is available in the SCB device.

EXAMPLE 5

The tests described in Example 1 were repeated under different conditions. The results are shown in Table 4.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An explosive device comprising:

a non electrically conducting substrate;

an electrical material mounted on said substrate and having a negative temperature coefficient of electrical resistivity at an elevated temperature, said material covering an area of said substrate and defining a pair of spaced pads connected by a bridge, the area of each of said pads being much larger than the area of said bridge, the resistance of said bridge being less than about three ohms;

a metallized layer covering each of said spaced pads;

an electrical conductor connected to each of said metallized layers, whereby the electrical resistance between said electrical conductors is substantially determined by the electrical resistance of said bridge; and an explosive material covering said device, the area of said bridge in contact with said explosive material being sufficient to ignite said explosive material when said bridge forms a plasma due to electrical current passing therethrough.

2. An explosive device of claim 1 wherein said electrical material is a semiconductor material.

3. An explosive device of claim 2 wherein said semiconductor material is polycrystalline.

4. An explosive device of claim 2 wherein said semiconductor material is crystalline.

5. An explosive device of claim 2 wherein said semiconductor material is crystalline and is mounted on a lattice matched substrate.

6. An explosive device of claim 2 wherein the electrical resistance of said bridge is about 1 ohm.

7. An explosive device of claim 6 wherein the area of said bridge is equivalent to approximately 100 $\mu m \times 100$ $\mu m \pm$one order of magnitude.

8. An explosive device of claim 3 wherein said polycrystalline material is polycrystalline silicon doped to a level of about $10^{19}$ dopant atoms per cubic centimeter of silicon.

9. An explosive device of claim 2 wherein said explosive material is a high explosive.

10. An explosive device of claim 8 wherein said dopant material is phosphorus atoms.

11. An explosive device comprising:

a non electrically conducting substrate;

a semiconductor mounted on said substrate and having a negative temperature coefficient of electrical resistivity at an elevated temperature, said semiconductor covering an area of said substrate and defining a pair of spaced pads connected by a bridge, the area of each of said pads being much larger than the area of said bridge, the resistance of said bridge being less than about three ohms;

a metallized layer covering each of said spaced pads, the border between the semiconductor surface which is covered by said metallized layer and that which is not defining a triangular indentation whose base lies along said border and whose apex is located on said uncovered semiconductor surface side of said border;

an electrical conductor connected to each of said metallized layers, whereby the electrical resistance between said electrical conductors is substantially determined by the electrical resistance of said bridge; and an explosive material covering said device, the area of said bridge in contact with said explosive material being sufficient to ignite said explosive material when said bridge forms a plasma due to electrical current passing therethrough.

* * * * *